US005238230A

United States Patent [19]

Cochran

[11] Patent Number: 5,238,230

[45] Date of Patent: Aug. 24, 1993

[54] INSULATION MEMBERS FOR SLAB REHEAT FURNACE

[76] Inventor: Johnny W. Cochran, 3355 Sectionline Rd., Albertville, Ala. 35950

[21] Appl. No.: 898,721

[22] Filed: Jun. 15, 1992

[51] Int. Cl.[5] ..... F27D 5/00

[52] U.S. Cl. ..... 266/274; 432/234

[58] Field of Search ..... 266/274; 432/234; 138/147, 149

[56] References Cited

U.S. PATENT DOCUMENTS 3,226,101 12/1965 Balaz et al. ..... 266/274
4,140,484 2/1979 Payne ..... 432/234
4,386,630 6/1983 Gapinski ..... 138/149
4,402,345 9/1983 Twort ..... 432/234

*Primary Examiner*—Scott Kastler
*Attorney, Agent, or Firm*—Veal & Associates

[57] ABSTRACT

Thermal insulation members for water cooling pipes in slab furnaces are provided which eliminate the need for welded attachment of the insulation to the pipes. The refractory material is formed for cooperative axial engagement such that a single U-shaped member and a pair of plugs encircles the pipe while in an integrated self-supporting interlock while leaving the upper skid rail unobstructed.

7 Claims, 2 Drawing Sheets

FIG. 1
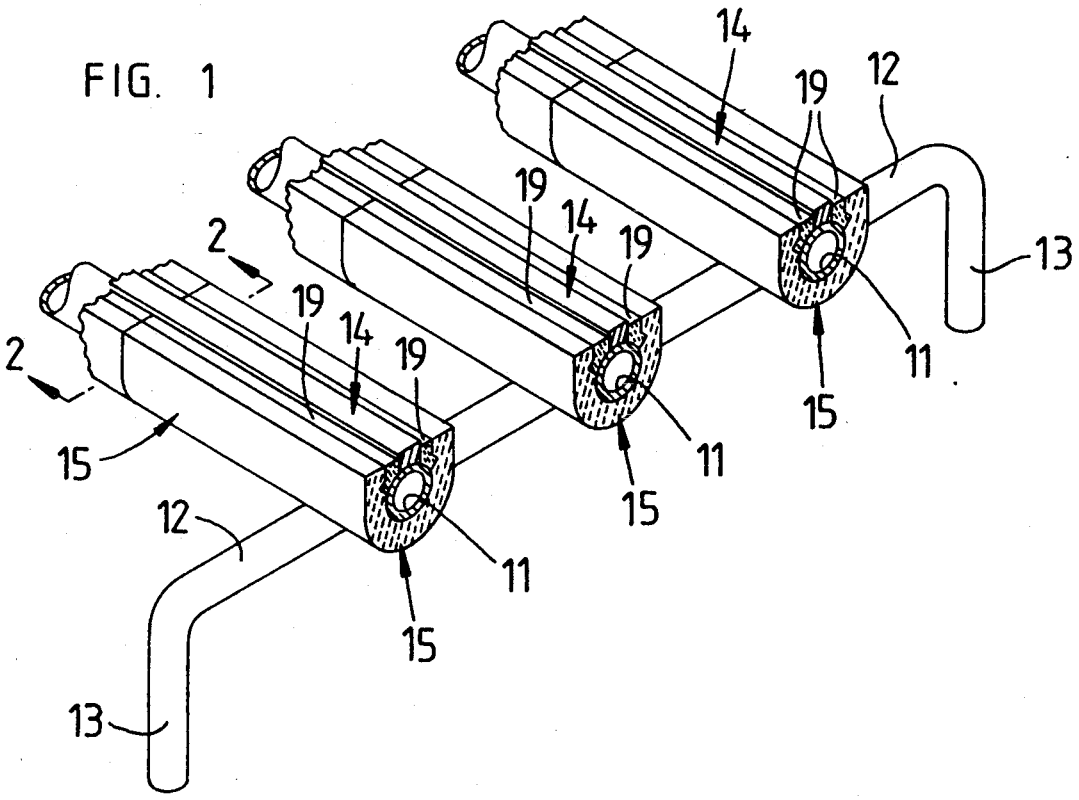
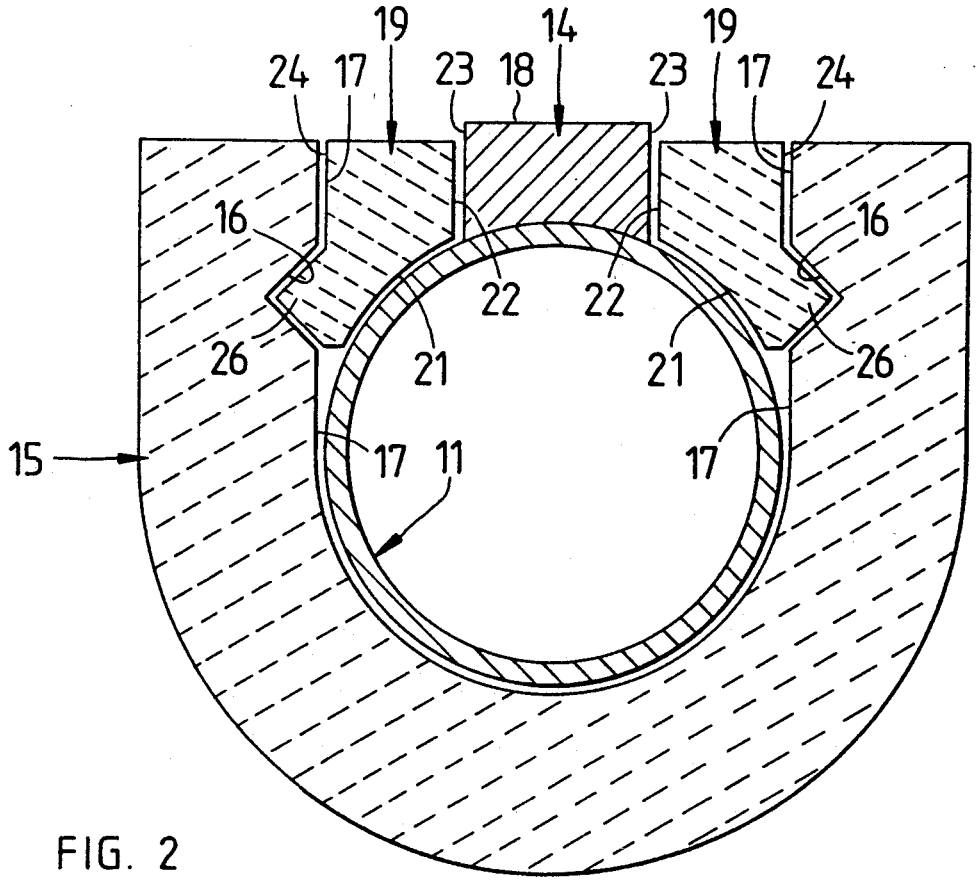
FIG. 2

INSULATION MEMBERS FOR SLAB REHEAT FURNACE

FIELD OF THE INVENTION

The present invention relates to the thermal insulation of cooling members in reheating furnaces. In particular, the present invention relates to refractory units for insulating furnace skid rails while heated slabs are still in place on such skid rails.

BACKGROUND OF THE INVENTION

A common practice in steel mills is the reheating of slabs or billets in furnaces wherein temperatures exceed 2,000° F. These slabs or billets move along raised rail-like extensions of hollow pipe members. Cooling water is circulated through the pipes to prevent fusing of the slab material and the rail-like extension. The cooling pipes are commonly sheathed with refractory material to prevent cooling the entire furnace below efficient operating levels.

The refractory material used to sheath the cooling pipes must be extremely durable to withstand an intense heating environment. Massive slabs moving along the protruding rails cause vibration which can induce deterioration of the refractory material. Thus, the combination of alternating steep thermal gradients accompanied by intense vibrations requires a very stable sheathing.

In the past, securing means such as lugs and tabs welded to the cooling members have been necessary to enable the refractory material to withstand the vibration induced trauma. However, the repair or replacement of the refractory material requires a labor-intensive time consuming process. The old material had to be removed as well as hot-rodding off the old stainless steel welds. Then new pieces must be tied in place and welded. Finally, masons must plaster over the welds to protect from heat and increase the useful life of the welds.

There have been some improvements reducing the amount of labor in applying refractory material. One such improvement is a refractory tile of a C-shaped block with a hollow side to engage the cooling member. This block has an upper end engaging over the cooling member with a lower end that swings under gravity and engages underneath the member with a complimentary tile. Problems with this design still persist in that refractory mortar must be used in the gaps between the skid rail and the upper end of the refractory tile. This requires that the slab be removed from the furnace anytime repairs or replacements are attempted. The two piece design engaging beneath the support member is prone to separation caused by intense vibration. The introduction of slag between the engaging tiles will facilitate such separation and all thermal advantages will be lost. The block is not economically feasible because the heat loss is less expensive than the cost of production and for this reason is not extensively used.

The present invention provides a refractory tile that can be introduced or repaired on a cooling member without the removal of the slab. This is an extreme advantage in the amount of energy that is likely to be needed to bring the slab and furnace up to rolling temperature. The repair time will be reduced resulting in less down time of operations.

BRIEF SUMMARY OF INVENTION

Refractory material in the present invention includes a plurality of U-shaped ceramic units. These units fit snugly about the cooling member with the upper portion of the "U" extending upward to a level below the slab. An inwardly facing set of opposing channels are formed on the upper interior of the U-shaped unit. A set of plug units accompany each tile unit and have an arcuate face mated to the surface of the pipe and a portion extending up against the protruding rail. These plugs include extending splines which lock into the channel thereby securing the U-shaped unit in place. This snug fitting unit requires no mortar to cover the welds; therefore, the slab need not be removed from the furnace. Also, the majority of the unit is one snug fitting piece and as such is less susceptible to disengagement by vibration or introduction of slag.

BRIEF DESCRIPTION OF THE DRAWINGS

Apparatus embodying features of my invention are depicted in the accompanying drawings which form a portion of this disclosure and wherein:

FIG. 1 is a perspective illustrating portions of a typical reheat furnace including skid pipes, uprights, crossovers and applicant's refractory units in place;

FIG. 2 is a cross section of a skid pipe with refractory tile unit and plugs taken on plane 2—2 of FIG. 1;

DESCRIPTION OF THE PREFERRED EMBODIMENT

Figure 3:
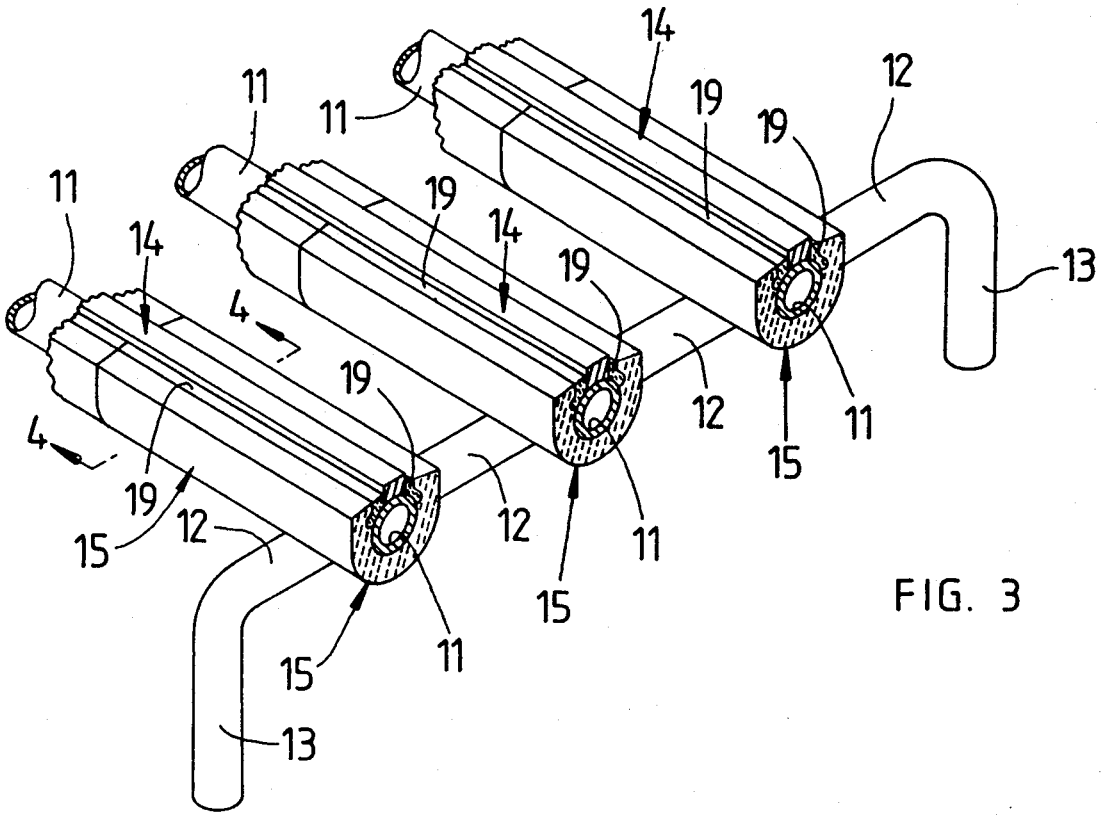
FIG. 3 is a perspective illustrating portions of a second embodiment wherein the U-shaped refractory unit and the plug units are outwardly angled.
Figure 4:
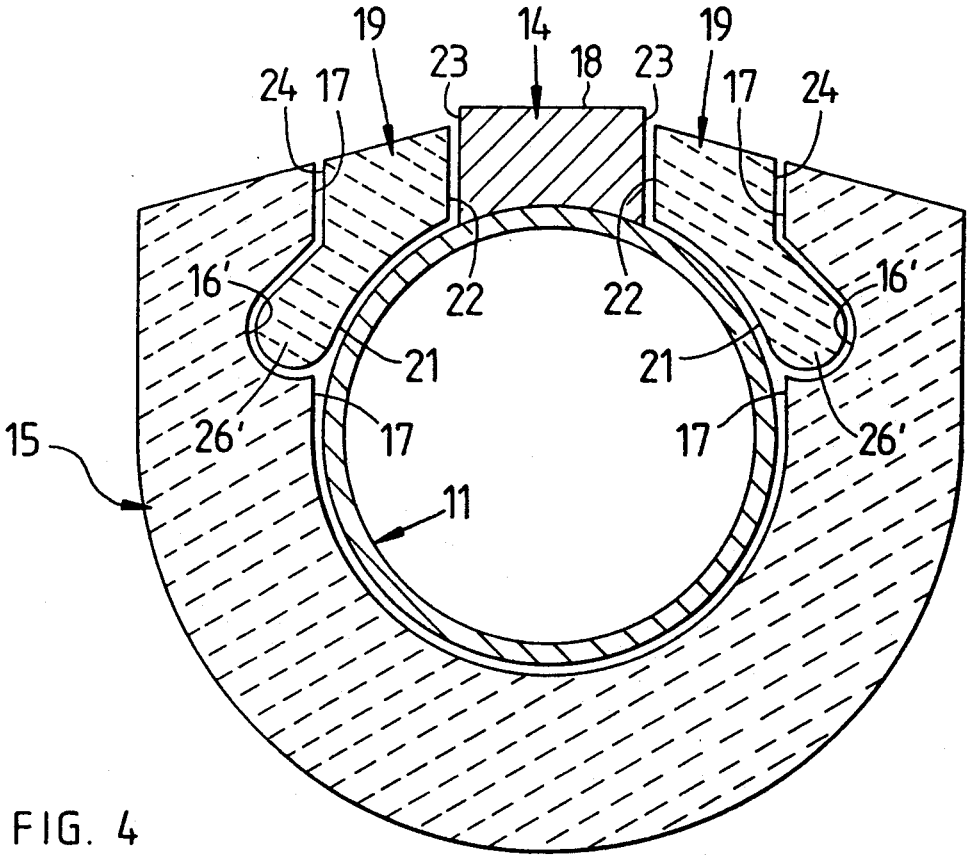
FIG. 4 is a cross section of a skid pipe with refractory tile unit and plugs taken on plane 4—4 of FIG. 3 which is the outwardly angled second embodiment.

The present invention contemplates insulating reheat furnace skid pipes with slabs or billets in place. There are also no welds or adhesives required for the present invention thereby reducing the amount of labor and time required to install or replace the refractory material.

Referring to the drawings for a clearer understanding of the invention, it is noted that skid pipes 11 are supported by crossovers 12 in FIG. 1. The crossovers 12 are in turn held in position by uprights 13 which protrude from the furnace floor. The crossovers 12 and uprights 13 are hollow and normally filled with a cooling liquid such as water and are insulated in conventional manners generally known in the industry. A skid rail 14 is carried by each kid pipe 11 supporting t he slabs or billets as they are urged through the reheat furnace. In FIG. 2 a cross-section view of a single skid pipe 11 is shown including skid rail 14. The skid pipe 11 is hollow and a cooling liquid is circulated through the skid pipe 11 in a system that is normally separate and apart from cooling system of the crossover 12 and upright 13.

In the present invention the skid pipe 11 is engaged from beneath by a ceramic U-shaped refractory unit 15 that substantially surrounds the skid pipe 11. The refractory unit 15 is approximately two inches thick as shown in FIG. 2. Near the open ends of the refractory unit 15 are opposing angular channels 16 formed in the interior surface 17 of refractory tile 15 approximately one inch from the open ends of refractory tile unit 15. The open ends of refractory tile unit 15 do not extend above the top surface 18 of skid rail 14 so as not to interfere with passing slabs or billets.

The present invention includes plug units 19 made of refractory material as shown in FIG. 2. These plug units 19 are approximately 1¼ inch wide and lock the refractory tile unit 15 snugly in place. These plugs 19 have faces 21 that arcuately engage a portion of skid pipe 11. Also, an inside face 22 of plug 19 rests flat against a side face 23 of skid rail 14. Another side of the plug units 19 has a flat face 24 which mates with interior surface 17 of refractory tile unit 15. Also, a spline 26 extends outwardly about 3/16 of an inch beyond the flat surface 24 to engage one of the opposing angular channels 16 thus locking the plugs into the channels to prevent disengagement. The plug units 19 do not extend above the top of skid rail 14 in order to prevent interference with the movement of slabs and billets.

The skid pipe is essentially surrounded by refractory material leaving only the top surface 18 of skid rail 14 exposed. The plug units 19 fit tightly against the sides 23 of skid rail 14 requiring no mortar for a seal. In addition, the splines 26 lock the refractory tile units 15 in place preventing them from becoming disengaged due to the intense vibrations caused by moving slabs or billets.

This system requires no adhesives to affix the refractory tile unit 15 to skid pipe 11 and as such requires a minimum of labor and time. Further, no welds or tabs are required therefore mortar is not required to cover welds or tabs. Still further, the refractory tile unit 15 and plug units 19, which are slightly shorter than skid rail 14, preventing contact, so that installation is possible with slabs or billets in place. Less down time and heat loss are encountered by not having to remove slabs or billets from the reheat furnace making the present invention economically efficient.

FIG. 3 shows an alternative to the preferred embodiment. In this embodiment the upper contiguous surface of the U-shaped refractory unit 15 and the plug unit 19 slope downwardly and outwardly from the skid rail to permit slag to slide off the top thereof. Also note that the channels 16' and spline 26' are modified such that a curvilinear junction is formed therebetween to reduce shearing at any particular point.

While I have shown my invention in two forms, it will be obvious to those skilled in the art that it is not so limited but is susceptible of various changes and modifications without departing from the spirit thereof.

What I claim is:

1. Apparatus for insulating skid pipes in a furnace for heating billets of metal wherein said skid pipes have an integral skid rail formed along the top thereof comprising:

(a) a U-shaped refractory unit having opposed end pieces extending upwardly about said skid pipe on either side of said skid rail said end pieces having opposed inwardly facing channels formed therein; and (b) locking means, made from refractory material, for securing said U-shaped refractory material to said skid pipe by interstitial engagement with said skid pipe, said skid rail and said U-shaped refractory unit and said channels.

2. Apparatus as defined in claim 1 wherein said locking means comprises a pair of plug units each having a spline thereon adapted to mated engagement within one of said channels of said refractory unit.

3. Apparatus as defined in claim 2 wherein each plug unit of said pair of plug units includes an linear face abutting said skid rail and an arcuate face abutting said skid pipe.

4. Apparatus as defined in claim 2 wherein said plug units and said U-shaped refractory unit extend upwardly to a height less than the height of said skid rail.

5. A refractory tile unit according to claim 4 wherein an upper surface of said U-shaped unit and one of said pair of plug units slope downwardly and outwardly from said skidrail extension whereby slag can be removed by the force of gravity.

6. A refractory tile unit according to claim 2 wherein said opposing channels are arcuate grooves cut into interior surface of said U-shaped unit.

7. A refractory tile unit according to claim 2 wherein said opposing channels are angular grooves cut into interior surface of said U-shaped unit.

* * * * *